US006752272B2

(12) United States Patent
Jones et al.

(10) Patent No.: US 6,752,272 B2
(45) Date of Patent: Jun. 22, 2004

(54) UNIT DOSE PACKAGING SYSTEM WITH EXTERIOR POCKET FEATURE

(75) Inventors: Brad A. Jones, Chesterfield, VA (US); Meredith M. Karow, Midlothian, VA (US); Mohan Sasthav, Elkridge, MD (US)

(73) Assignee: Mead Westvaco Corporation, New York, NY (US)

( * ) Notice: Subject to any disclaimer, the term of this patent is extended or adjusted under 35 U.S.C. 154(b) by 0 days.

(21) Appl. No.: 09/950,975

(22) Filed: Sep. 13, 2001

(65) Prior Publication Data

US 2003/0047482 A1 Mar. 13, 2003

(51) Int. Cl.[7] ..... B65D 83/04
(52) U.S. Cl. ..... 206/534; 206/528; 206/232
(58) Field of Search ..... 206/528, 531, 206/532, 534, 232; 229/125.125

(56) References Cited

U.S. PATENT DOCUMENTS 4,132,348 A * 1/1979 Bromberg ..... 229/75
4,134,495 A * 1/1979 Friedman ..... 206/387.11
4,413,730 A * 11/1983 Morse ..... 206/232
4,643,301 A 2/1987 Hehn
5,174,442 A 12/1992 Kurnit
5,433,317 A 7/1995 Roser
5,820,165 A 10/1998 Verenski
6,047,829 A 4/2000 Johnstone et al.
6,070,719 A * 6/2000 Pollock ..... 206/232

FOREIGN PATENT DOCUMENTS

| | | |
|---|---|---|
| EP | 0818393 | 1/1998 |
| GB | 2330572 | 4/1999 |

* cited by examiner

*Primary Examiner*—David T. Fidei
(74) *Attorney, Agent, or Firm*—MeadWestvaco Corporation; Michael V. Drew, Esq.

(57) ABSTRACT

A two-piece package for housing and dispensing a unit dose product. The product to be dispensed is contained on an internal slide card that is removably and lockably engaged within an outer sleeve. The package sleeve includes an exterior panel having an inner pocket for accommodating an insert. This package may include additional features that provide a child resistant and user-friendly dosing means that can be opened and closed numerous times while in use, then disposed of when the all the unit doses are exhausted.

20 Claims, 13 Drawing Sheets

UNIT DOSE PACKAGING SYSTEM WITH EXTERIOR POCKET FEATURE

The invention relates to a paperboard package for containing unit dose materials, the unit doses being encapsulated on an internal slide card within an outer sleeve. In its broadest aspect, the package blank is formed with an extra panel which, when folded, forms a pocket for holding a loose insert. The construction allows the insert to be placed within the pocket during machine folding of the package. The package may also include features that render it suitable for packaging unit doses while meeting regulatory criteria for child resistance by the inclusion of a pull-out mechanism comprised of offset notches for withdrawing the internal slide card from the outer sleeve, in combination with a false bottom that provides additional support to the outer sleeve, and tear resistant lamination of at least a portion of the sleeve.

BACKGROUND OF THE INVENTION

Unit dose packaging is an attractive packaging format for certain pharmaceutical applications because it is convenient, yet sturdy enough to be opened and closed numerous times until the course of medication is completed, and also enables the user to track the consumption of doses according to the prescribed schedule. Examples of such packaging are described in U.S. Pat. No. 6,047,829 (Johnstone), which is commonly assigned with the invention described herein. The Johnstone patent relates to a unit dose paperboard package that includes an outer paperboard sleeve, an inner paperboard slide card that is lockably retained within the sleeve. The sleeve includes a plurality of side panels operatively connected to each other such that one of said plurality of side panels includes a first inner slide card releasing means, and another of said side panels includes a second inner slide card releasing means, such that the inner slide card retaining and releasing means are located substantially adjacent to said unit dose dispensing means.

It is also desirable for a unit dose package to carry product information, dosing instructions or other information. The package surfaces often do not provide enough space that can be printed with all the necessary information. In traditional packaging formats, therefore, a product insert is often included in the package interior or otherwise attached to the package exterior as an outsert.

U.S. Pat. No. 5,820,165 (Verenski) discloses a folding carton with an extension panel, which may be detachable or non-detachable, attached at the edge of the front panel. A brochure or pad is attached, such as by gluing or stapling, between the front panel and this extension panel. The extension panel and the underlying brochure are then held closed by wafer seals adhesively attached to the outside of the extension panel and the box body. In a similar fashion, U.S. Pat. No. 5,433,317 (Roser) discloses a box with an integrated multi-page booklet that is glued, stapled or sewn, and thus protected, beneath an auxiliary flap on the outside of the box. The rear panel of the booklet serves as the point of attachment to the box. U.S. Pat. No. 4,643,301 alternatively discloses a plastic videocassette storage container in which a booklet is inserted inside a pocket exterior to the main compartment of the box. The pocket is formed by a flat plate of stiff plastic material having outwardly projecting flanges along three of its sides. This plate snap-fits onto the bottom wall of the video cassette container and is held in place by a pair of clips.

The foregoing patents demonstrate means for externally attaching a booklet to boxes. However, a means for incorporating literature material into a unit dose package using an external attachment has not previously been contemplated. Such a package should desirably accommodate one or more sheets of printed material, but should also be disposed for folding and forming in a completely automated process. This capacity for automation is favorable because a fully machine-compatible process decreases production costs and increases production efficiency and capacity. In this respect, a package that necessitates gluing, stapling, sewing or any additional steps to fasten the literature material to one or more surfaces of the package, as demonstrated by the prior art patents discussed above, is not preferred.

The invention described herein is an improvement over that described and claimed in U.S. Pat. No. 6,047,829, in that the package is rendered less susceptible to unintentional opening and has improved structural stability. Child resistance is a feature particularly desired for pharmaceutical packaging, and is mandated by the Poison Prevention Packaging Act of 1970. For a desired child resistance (CR) rating of F=1, a random sampling of the subject packages may not be compromised by an age specific test pool of children at a failure rate of greater than 10%. This general guideline is designed to ensure that the package has sufficient integrity against tampering by children. In view of this desired requirement, it is an object of the invention to provide a unit dose packaging system with improved child resistance, which prevents unauthorized access to the package contents.

In addition to child resistance, however, it is also desirable that the unit dose packaging system be senior friendly to permit easy withdrawal of the package contents with minimum manipulation. Such a withdrawal means should be easy to use even if the patient's manual dexterity or strength is reduced. Accordingly, another object of the present invention is to provide a senior friendly package that can be easily manipulated by the user.

The aforementioned objectives and the recognized deficiencies in the prior art with respect to the incorporation of literature materials and the recognized need for a machine-friendly unit dose package having greater capacity to accommodate printed information are met by the packaging system, articles and methods of the present invention, which are described and claimed below.

SUMMARY OF THE INVENTION

The invention broadly comprises an outer paperboard sleeve and an inner paperboard slide card lockably retained within said outer sleeve; the outer sleeve further comprising an external panel having a pocket therein for accommodating a loose insert. The need for greater storage space to house inserts and other printed material such as coupons or promotional materials is also met by the inclusion of this external panel. Advantageously, the exterior panel may be folded to provide the package with a rectangular profile that allows efficient stacking for storage or transport.

In another aspect, the invention additionally meets the needs for child resistance and senior friendliness by providing a unit dose paperboard package having a locking feature that permits the package to be opened and closed during repeat usage, then disposed of when all the unit doses have been consumed. The package comprises an outer sleeve, which may be at least partially laminated to provide tear resistance, said sleeve further comprising an internal structural support formed from a panel extension thereof; an internal slide card, and a foldover panel, which when folded, forms a pocket for housing an insert. In this latter aspect, therefore, the invention comprises:

a) an outer sleeve including a plurality of side panels, a plurality of hinge panels, said side panels and hinge panels being operatively connected to each other; and wherein at least one side panel includes a foldable extension thereof, said extension being folded toward the interior of the sleeve to form a false bottom; and further wherein one of the side panels includes an internal slide card retaining element and a first inner slide card releasing element, and another of said plurality of side panels includes a second inner slide card releasing element; wherein the outer sleeve includes a pair of offset notches for grasping and removing an internal slide card; and wherein the outer sleeve is at least partially laminated with a polymeric film material;

b) a foldable exterior panel hingedly attached to one edge of the outer sleeve, said exterior panel being formed from an extension panel divided into two sections by a fold line, the sections being folded about the fold line to form the exterior panel having an interior pocket; and c) an internal slide card having encapsulated thereon one or more blisters each containing a unit dose of a material to be dispensed, the slide card being comprised of a slide card body and an extension, the extension being folded inward and positioned parallel to the slide card body when the package is closed.

In another aspect, the invention comprises a blank for forming a lockable outer sleeve of a unit dose package comprising a plurality of side panels, an extension panel divided by a fold line, and a plurality of hinge panels; at least one of said side panels comprising an extension thereof forming an internal slide card retaining element, and at least one side panel thereof additionally comprising a first internal slide card releasing element; and at least another side panel comprising a second internal slide card releasing element; and further comprising, in combination, a pair of notches, each notch being formed along an outer edge of the sleeve in an offset parallel relationship to the other, and a false bottom formed by a foldable extension of at least one side panel.

In yet another aspect of the invention, there is disclosed a method of packaging unit doses of a periodically dispensable material comprising:

a) cutting a blank for forming an outer sleeve from a substrate material, the blank having an extension panel having a fold line disposed thereon; the blank further including a pair of notches positioned in an offset parallel relationship to each other when the blank is folded;

b) forming an internal slide card from a substrate material, said internal slide card including a body and a foldable extension thereof;

c) folding the blank to form an outer sleeve including a plurality of side panels, the side panels having included therein at least one slide retaining means and at least one slide releasing means, at least one side panel comprising a foldable extension thereof which, when folded, forms a false bottom within the interior of the sleeve;

d) folding the extension panel about the fold line and affixing the edge thereof to the outer sleeve to provide a symmetrically folded exterior panel with an interior pocket;

e) encapsulating unit doses of a material onto the internal slide card;

f) folding the extension of the slide card to position the extension parallel to the body of the slide card;

g) inserting the folded slide card into the sleeve such that the extension thereof becomes slidably and lockably engaged with the slide retaining means in the side panels of the sleeve; and h) placing an insert within the interior pocket of the exterior panel.

A unit dose package according to the invention is thus composed of an internal slide card within a lockable outer sleeve having a pocketed external panel that holds informational or promotional material. The outer sleeve or the internal slide card may be cut from any suitable material, for example plastic, paperboard or, if desired a laminate of paperboard and another foldable material, for example a foil or a polymeric film. Suitable paperboard materials are described, for example, in U.S. Pat. No. 6,047,829, the entire disclosure of which is herein incorporated by reference. The selection of this substrate may be made according to the packaging need, and accordingly, a substrate material generally recognized as safe (GRAS) by the FDA is also within the scope of the invention. In certain preferred embodiments, the substrate may be selected from a sheet of bleached sulfate board, solid unbleached sulfate board (SUS), clay-coated newsback (CCNB), or any other suitable board substrate, such a substrate preferably ranging in thickness from about 0.008 inches up to about 0.050 inches. For example, the paperboard may be clay coated on one side (C1S) or on both sides (C2S), with a coating such as a fluidized blend of mineral pigments selected from coating clay, calcium carbonate and/or titanium dioxide with starch or adhesive, or various combinations of these materials. Successive densification and polishing (via calendering) finishes each coated surface to a high degree of smoothness and renders it suitable for graphics printing of superior quality.

The sleeve includes a plurality of side panels forming the wider surfaces of the package, these side panels being operatively connected by a plurality of hinge panels, and an extension panel which, when folded, provides an exterior panel that is similar in dimension to the side panels. Preferably at least one of the plurality of side panels includes an internal slide card retaining element and a first internal slide card releasing element, while another of the plurality of side panels includes a second internal slide card releasing element. The internal slide card releasing elements may be selected from cut-outs, slits, nodes, tabs or any other means for engaging a portion of the slide card with the outer sleeve. In certain preferred embodiments, the internal slide card retaining elements are extension panels. The first internal slide card releasing element is preferably composed of a cut away region that includes a node for engaging an extension of the slide card in at least one side panel, while the second internal slide card releasing means is preferably in the form of a release button located in yet another of the plurality of side panels. The internal slide card itself may be fitted with blisters or other discrete elements for holding unit doses; or, alternatively, may be an internally movable card that is connected by mechanical means such as tabs, slots, nodes or other engaging means to a blister card or other card housing the consumable good. In the latter respect, the sleeve may house two cards, one being a slide card that serves as a support for a blister card which may be attached to or detachable from the slide card by various attachment means.

The outer sleeve also includes an exterior panel or fifth panel that is movable about a folded hinge at one edge of main compartment of the package. This fifth panel is formed by cutting an extension panel along the free edge of one panel, preferably a face panel, of the blank. The extension panel may be separated from the face panel by a scored fold line or by a machine perforation that would permit detachment of the panel from the main compartment of the package, if desired. The extension panel preferably also includes a single fold line running parallel to its free edge. The extension panel may therefore be folded about this fold line to divide the panel into approximately equal sections, each facing the other, with the free edge affixed by glue or other suitable means near the fold line or perforation, the facing sections forming a pocket that is open at two opposing ends. Notches or cutouts may be included in one or both the facing sections to provide grip regions for access to and withdrawal of the insert. An insert of one or more printed sheets may be inserted into the pocket. Preferably, the insert is folded between the facing sections of the extension panel while the box is being formed in a machine folding process.

The panel and insert are sized to allow the insert to be securely retained in the pocket without using permanent fastening means such as glue or staples. In this manner, the user may completely withdraw the insert from the package. Once the extension panel is folded to form the pocket and the insert has been placed therein, the folded panel may be folded toward the surface of the exterior panel of the box and secured against the panel surface, for example by a removable adhesive seal. Securing the panel in this fashion adapts the package to an overall rectangular configuration that is more space-efficient for transport and storage.

Preferably, the sleeve blanks are cut, folded and glued in a machine operation. In this embodiment, sleeve blanks are placed in the feeding magazine of a conventional side-seam gluing machine. The blanks are run through the machine with appropriate folds and glue applied to form the package. Toward the end of the machine, an insert-feeding machine known in the industry as an inserter is positioned in such a way to feed inserts onto the carton blank. The speed and timing of the insert feed is controlled in order to maintain the friction between the insert and the partially formed carton, thus keeping them together. Fractions of a second after this step, the carton and insert are held together by the belts on the gluing machine. The extension panel is folded and glued at the side seam to form a pocket around the insert. After the side seam gluing is completed, the carton with insert is moved off the gluing machine. The aforementioned process provides certain benefits in the nature of easy removal and re-insertion of the insert and reduction in material costs, since no glue is needed to hold the insert in place.

The present invention also comprises various improvements to the sleeve element that contribute to the package stability. In one such modification, the sleeve blank may be cut to include an extension which, when folded inward, creates a false bottom in the lower end of the package. This false bottom, which is positioned beneath the release button located on the exterior of the paperboard sleeve, provides structural support to the package and causes the sleeve to be more resistant to deformation by squeezing or crushing. This feature is useful because such deformation can allow the release mechanism to be depressed and the locking mechanism of the package disengaged, thereby providing inadvertent access to the package contents. The inclusion of the false bottom also allows the release button to be located more towards the center of the package without also changing the dimensions of the internal slide card. This placement makes access to the release mechanism more difficult for a child.

Alternatively, areas of the sleeve that are susceptible to tearing may be formed from a double thickness of the substrate material. This feature reduces the possibility that the package may be torn open and also increases the overall sturdiness of the package exterior. To achieve this doubled thickness, the blank for forming the sleeve may be cut to include one or more panel extensions which can then be folded to lay parallel and adjacent to one or both side panels of the package. In one preferred embodiment, the panel extensions are formed at the side panels to provide a doubled thickness at the sleeve edges.

Depending on the choice of substrate material, another means of improving the impenetrability of the sleeve involves lamination of at least a part of one or both sides of the blank with a polymer film. In this manner, the exterior of the package is made more resistant to tearing. Optionally, this lamination may not extend over the entire surface of the sleeve blank. For example, only tear prone regions may require lamination. Suitable laminating materials may, for example, be selected from biaxially oriented or cross-laminated polymeric films such as high density polyethylene (HDPE), polyolefins, polyesters, e.g. Mylar™, or combinations thereof. In a related embodiment, tear resistance may be provided at stress points such as the package corners and exposed edges by applying one or more strips of the polymeric film, e.g. as a tape, over these areas. In either aspect, the polymeric film may be applied by extrusion or adhesive lamination, or by any other suitable means known in the art, typically to the side that is the interior surface of the blank. It has been found that this treatment significantly increases tear resistance and prevents tear propagation in the outer sleeve. Preferably, neither the complete laminate film nor the selectively applied film strips will detract from the package's aesthetic appearance or interfere with printability or any of the other desirable display features. Similar lamination with polymeric film may be used to treat the surface of the internal blister card. Text or graphic information may be printed on the sleeve or on the surfaces of the internal slide card according to any means conventionally known in the art.

Another feature that suitably contributes to the child resistance of the package according to the invention is the positioning of the cut-aways or notches for withdrawing the slide card from the interior of the sleeve. The package disclosed in U.S. Pat. No. 6,047,829 included notches that were symmetrically placed on corresponding edges of the side panels to form a cut out. According to the present invention, the placement of the notches is altered such that each notch on one side panel is offset from the other, with only a small area of overlap forming a cut out area exposing the edge of the internal slide card. To open the package, the user must therefore grasp the slide card through the offset notches. Because this step requires asymmetric placement of the fingers, which is counter-instinctive to children, their ability to grasp and withdraw the slide card is greatly reduced.

In other preferred embodiments of the invention, the outer sleeve of the package provides additional protection for the internal slide card, which houses the unit dose product being used. The internal slide card has a stop feature, typically a folded extension thereof, that engages with a catch feature, typically also a folded extension, on the outer sleeve, to prevent the user from pulling the internal slide card completely away from the outer sleeve.

Optionally, other means for improving the structural integrity of the overall package may be incorporated. Such features include lamination of the slide card with a polymeric film, as described above, which also improves tear resistance. In addition, the sleeve or the slide card may be constructed of a tear-resistant paperboard material.

DETAILED DESCRIPTION OF THE PREFERRED EMBODIMENTS OF THE INVENTION

According to the present invention, there is provided an improved unit dose packaging system comprising certain structural features that improve and/or enhance the child resistance and senior friendliness of the packaging.

Figure 1:
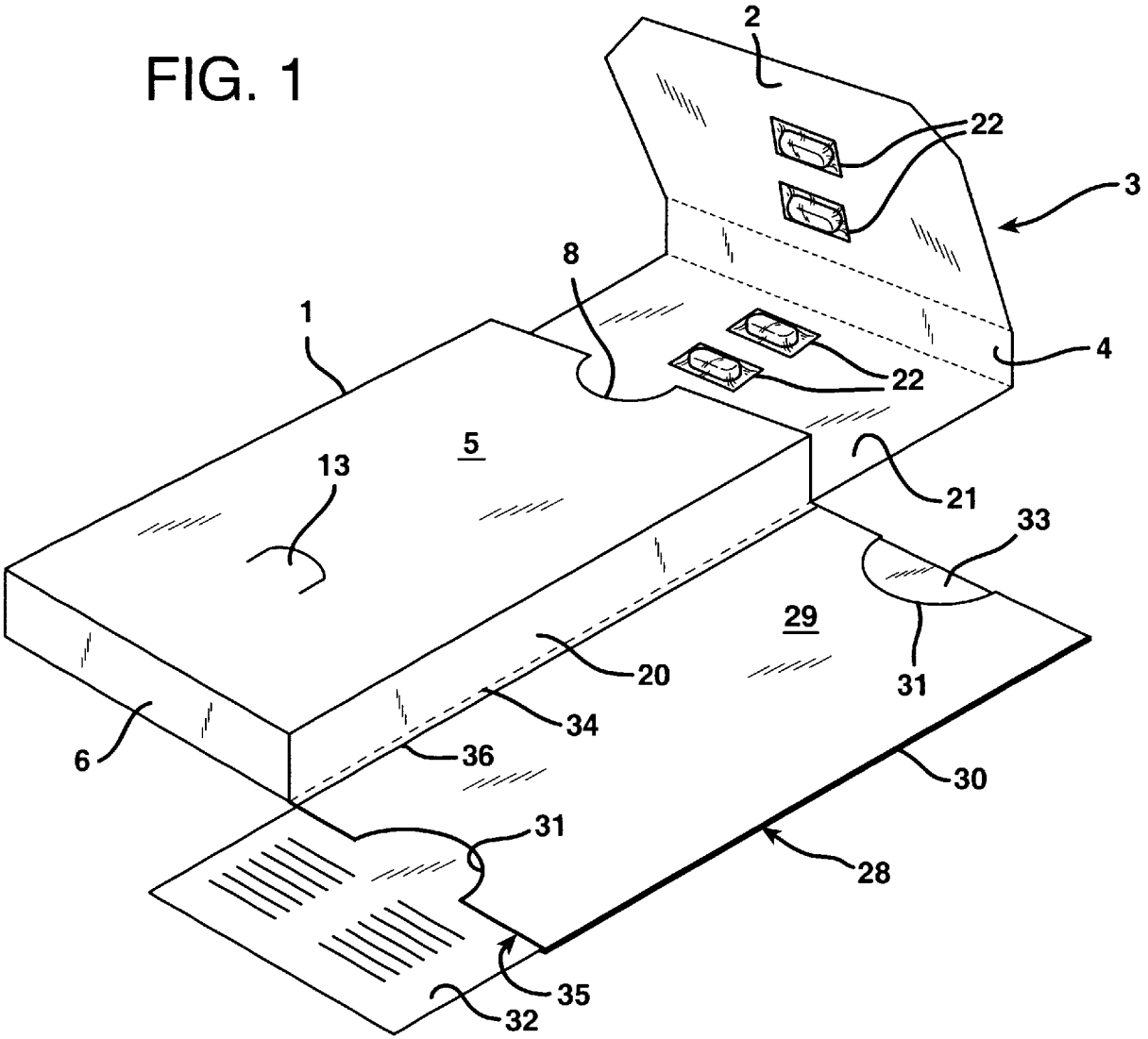
FIG. 1 is an isometric view of an opened package according to the invention including an internal slide card and outer sleeve with button release means.
Figure 2:
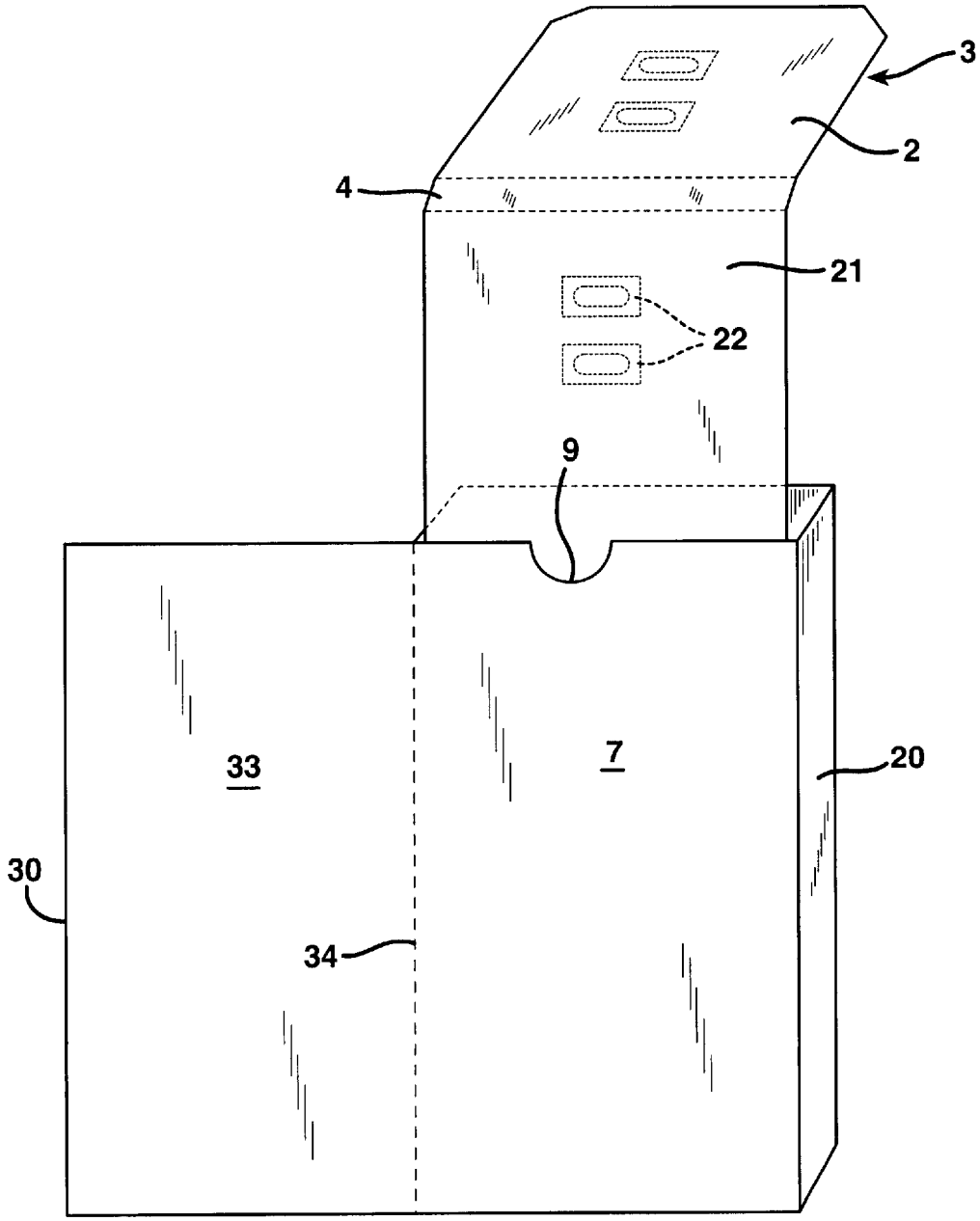
FIG. 2 is an isometric rear view of the partially opened package.

As represented in the accompanying figures, a preferred embodiment of the unit dose package of the invention comprises a slide card 3, which is releasably, lockably engaged with an outer sleeve 1. The package contents are contained in unit dose form on blisters 22 located on slide card 3. The sleeve 1 is composed of side panels 5 and 7, which are foldably connected by hinge panels 20, and a bottom panel 6, which secures one end opening of the package. As shown in FIG. 1, the side panel 5 comprises a release button 13, which is formed by a series of connected cuts in the substrate made by conventional techniques. The cut edges form a flexible tab that can be depressed to exert pressure on one or more layers of substrate underlying side panel 5. Side panel 5 also includes a notch 8 that provides a finger hold for withdrawal of the slide card 3. As represented in FIG. 2, a corresponding notch 9 having similar dimensions as notch 8 is positioned parallel to but offset from notch 8 in the edge of side panel 7. In the embodiment represented by FIGS. 1 and 2, the notch 8 is positioned close to the center of the edge of side panel 5, while notch 9 is positioned off center such that there is incomplete overlap with notch 8. The position of these notches along the outer edges of the sleeve and their placement in relation to each other may be varied depending on the overall dimensions of the package.

Figure 3:
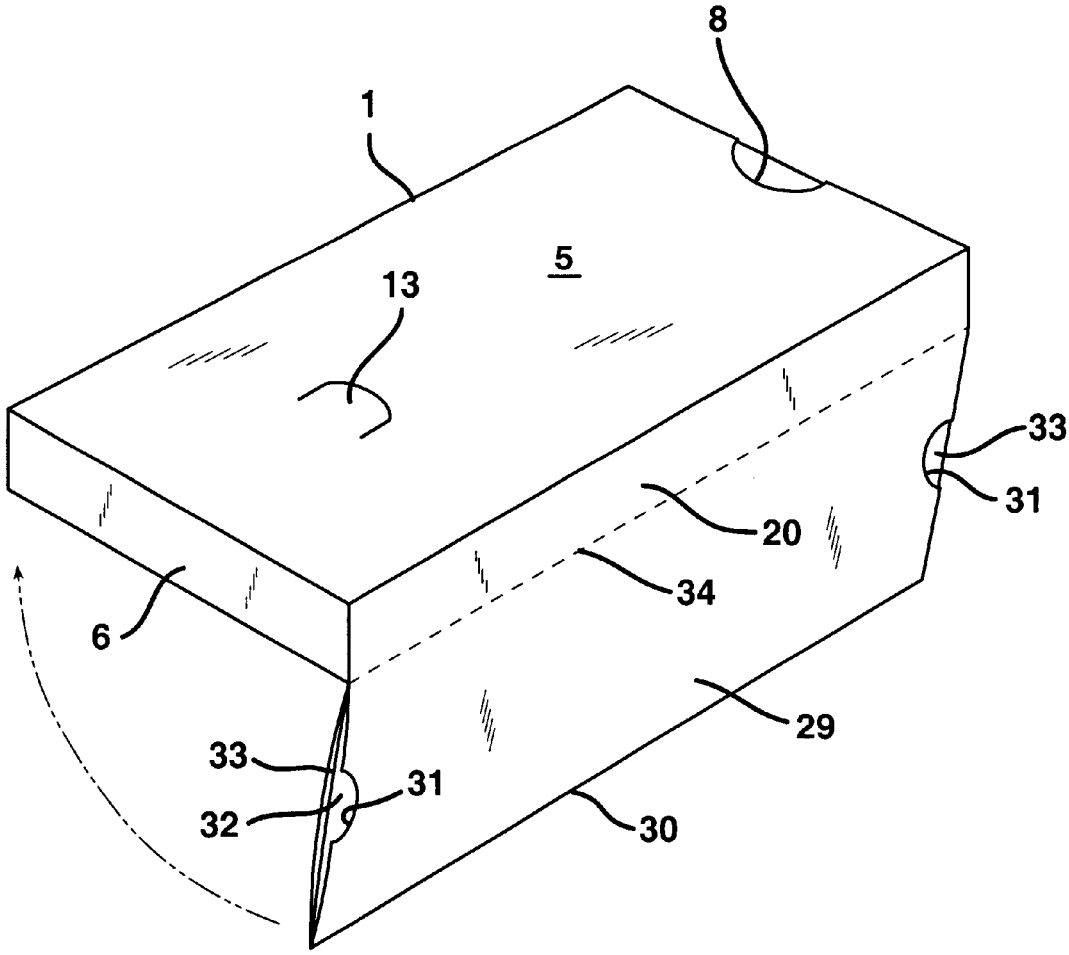
FIG. 3 is an isometric view of the closed package indicating the folding direction for compactly stacking the package.

Attached to one side of the sleeve 1 is an exterior panel 28 having an interior pocket 35 for holding an insert 32. Exterior panel 28 is composed of opposed panels 29, 33 divided by fold line 30. Edge 36 is glued to one panel of the sleeve 1. Notches 31, 33 formed in panel 29 provides grip regions for withdrawal of the insert 32. The exterior panel 28 is integrally formed as part of the sleeve blank, and is separated from the formed sleeve 1 by a perforated fold line 34. The exterior panel 28 may thus be easily detached along perforated fold 34 from the rest of the sleeve 1. The folding nature of the exterior panel also allows it to be folded inward toward the body of sleeve 1 to conform the panel to the overall shape of the package, as shown in FIG. 3. By this means, a package is formed that can hold a significantly greater amount of printed literature, i.e. the insert 32 as well as the surface area of both sides of the exterior panel 28, without significantly changing the spatial dimensions of the package.

Figure 4:
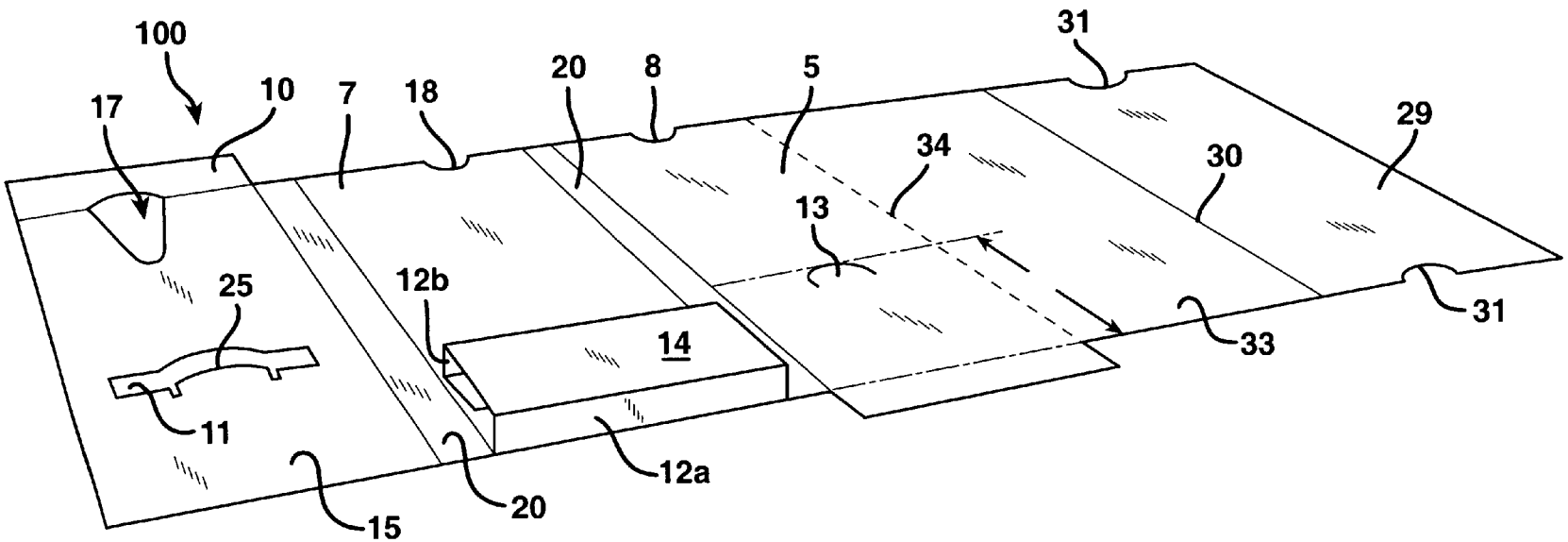
FIG. 4 is an isometric view of a partially folded blank for forming the outer sleeve of the package, according to one embodiment of the invention.
Figure 5:
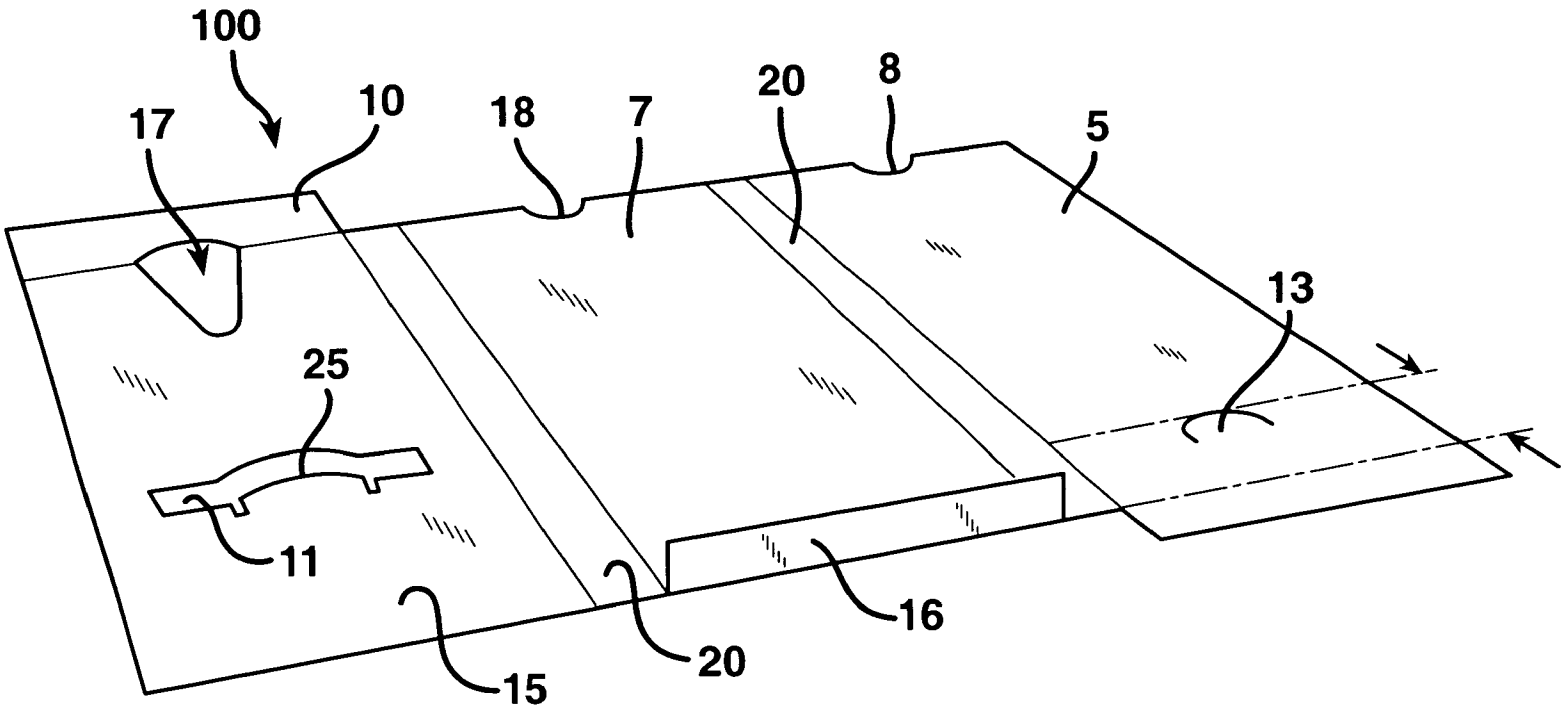
FIG. 5 PRIOR ART
FIG. 5 is partially folded sleeve for the prior art unit dose package system, as described in U.S. Pat. No. 6,047,829.

As shown in FIG. 4, the sleeve 1 is formed from a blank 100 that is scored to form five panels 5, 7, 15, 29 and 33. To form the sleeve, panel 15 is folded beneath and secured, for example using an adhesive, beneath panel 5, such that panel 15 is positioned within the interior of the formed sleeve 1. The panel 15 includes a panel extension 10, which acts as a stopping device that prevents the internal slide card 3 from being pulled completely out of the sleeve 1. In the preferred embodiment of FIG. 4, panel 7 includes an additional extension 14, which may be folded toward the center of panel 7 to form structural panels 12*a* and 12*b*, each being of dimensions identical to those of end panel 6, and a structural panel 14 which underlies panels 5 and 15 in the folded sleeve 1. In comparison to the prior art, as represented by FIG. 5, the sleeve of the present invention includes improvements in the form of structural panels 12*a*, 12*b* and 14, which reduce deformation of the side panels to release the locking mechanism, as may be achieved when the sides of the package are squeezed. These structural panels, in effect, form a false bottom that strengthens the package and thus renders it more tamper resistant. Panel 15 additionally includes a cut away area 11 having a node 25. The cut away area 11, node 25, release button 13, and extension panel 10 together form the locking assembly for the package of the invention. The locking mechanism operates similarly to that described in U.S. Pat. No. 6,047,829, previously herein incorporated by reference. The embodiment of FIG. 4 also includes cutaway areas 17 and 8, which, when folded together, form a notch that is paired with offset notch 18. Alternatively, a notch 9 may be formed from a folded extension 19 of one side panel 7, as is shown in FIGS. 7 and 8.

After the sleeve 1 is folded and glued, an insert is placed over one section 33 of the extension panel and the opposing section folded over fold line 30 to cover the insert. Edge 36 of section 29 is then glued near the juncture of the sleeve 1 and panel 33 to form the interior pocket 35 and secure the insert 32 inside. Alternatively, the interior pocket can be formed before insertion of the insert. Preferably, the sleeve blank 1 is cut, folded and glued in a machine operation.

Figure 6:
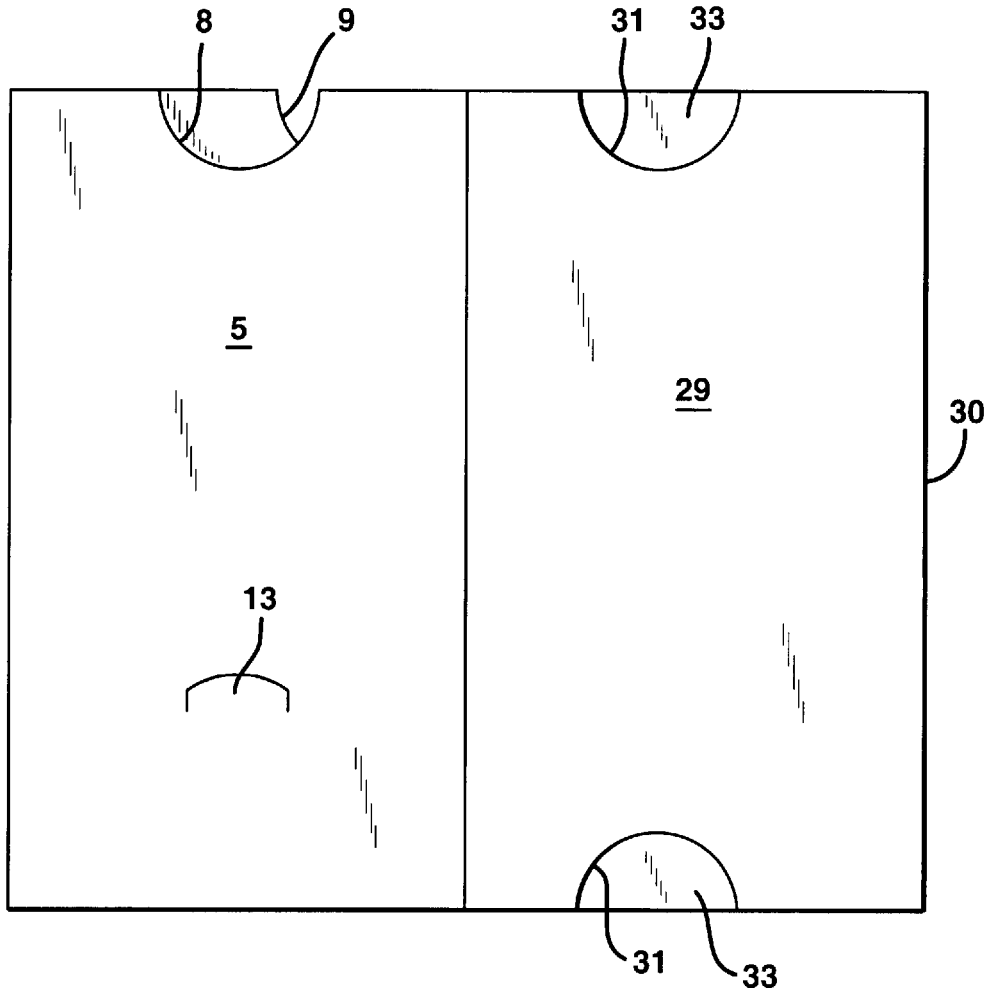
FIG. 6 is a two-dimensional representation of the sleeve side panels, as folded when the package of the invention is formed, showing the offset notches.

FIG. 6 demonstrates the offset notches, which provide an additional tamper resistance feature. The notches are cut in the edges of sleeve panels 5 and 7 such that there is a degree of overlap between the notches. In this manner, the user's fingers may be positioned in an offset manner to withdraw the internal slide card. Because this positioning is counter-instinctive, however, the placement of the notches heightens resistance of the package to tampering by children.

Figure 7:
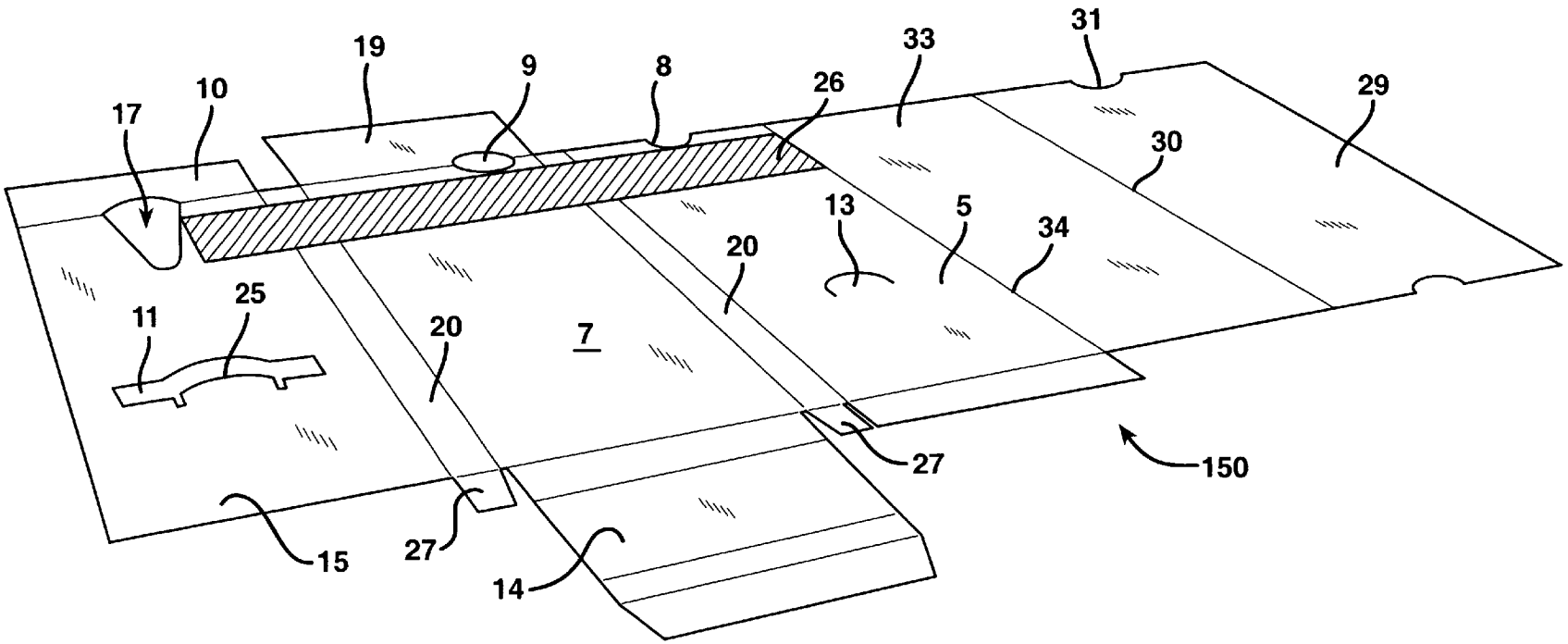
FIGS. 7 and 8 are plan drawings depicting various embodiments of the sleeve according to the invention.
Figure 8:
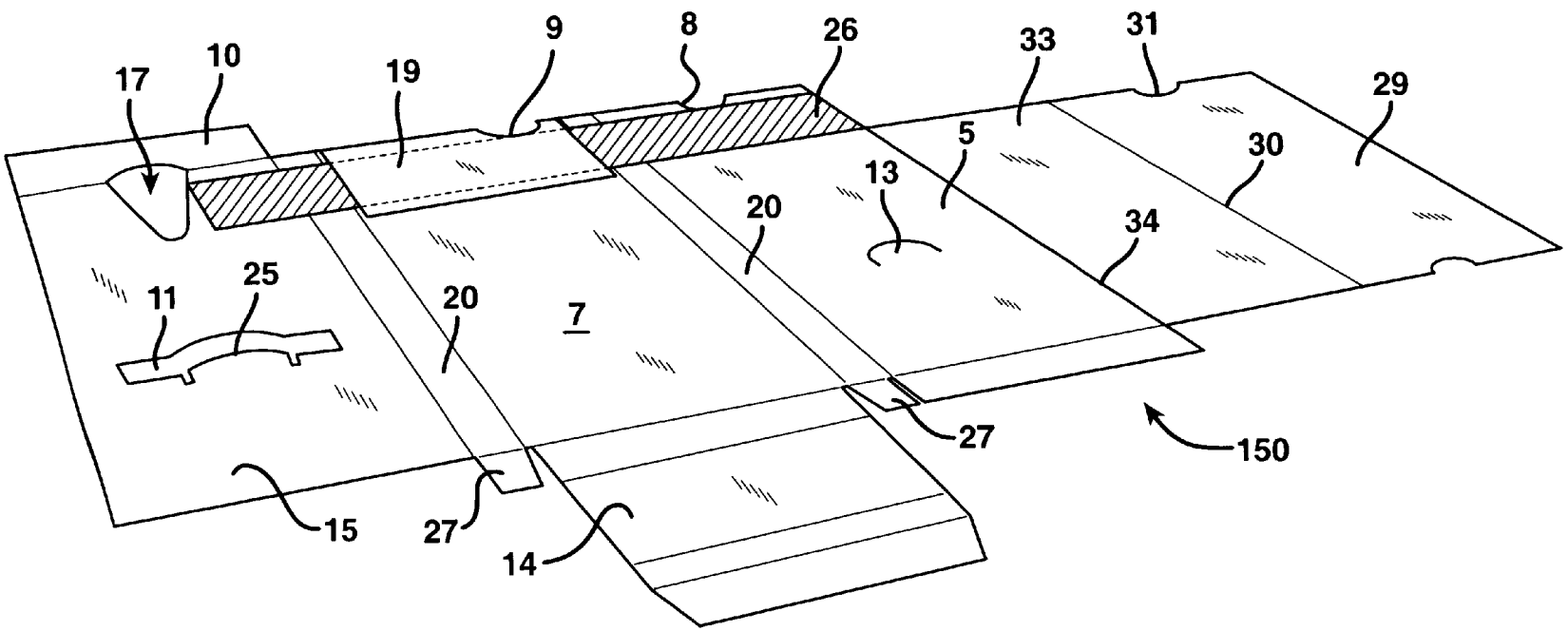

FIGS. 7 and 8 depict a blank 150 for forming the outer sleeve 1. The tri-panel construction includes side panels 5 and 7, as well as support panel 15, which folds beneath side panel 5. Minor flaps 27, which may optionally be included, provide additional structural support to the package edges. Panel 15 includes a cut away area 11 including node 25, the cut away being designed to fit between the panel 15 and folded extension 10, thereby providing a retention means that stops the complete removal of the internal slide card 3 from the sleeve. As an additional structural reinforcement feature, the blank 150 includes an extension 19, which, when folded toward the interior of the sleeve, provides additional structural enhancement of the sleeve to make it less susceptible to tearing. The panel 7 and extension 19 are cut with reciprocal circular or arcilinear cuts that form notch 9 when the extension 19 is folded. The embodiment represented by FIGS. 6 and 7 also includes a plastic film strip 26, which is adhered along the edges of panels 5, 7 and 15. The film strip 26 acts as a reinforcement of the edges of the outer sleeve 1 to prevent tear propagation. The edges of tape strip 26 may be positioned flush with the edges of side panels 5, 7, 15 and hinge panels 20, or it may be positioned behind the edges toward the interior of the blank 150. The tape strip 26 may be applied before or after the sleeve blank is cut. In a preferred embodiment, for example, the tape may be applied to a substrate material before it is die cut into blanks. Preferably, tape strip 26 does not extend across the entire width of panel 15 in order to prevent engagement of the internal slide card extension 24 with the strip 26 as it is being withdrawn and reinserted into the sleeve 1. In other embodiments, one or both surfaces of the blank 150 may be completely laminated with a polymeric film instead of being partially laminated with the film strip 26. Preferably, this lamination is performed before the substrate material for forming the sleeve blank is die cut.

Figure 9:
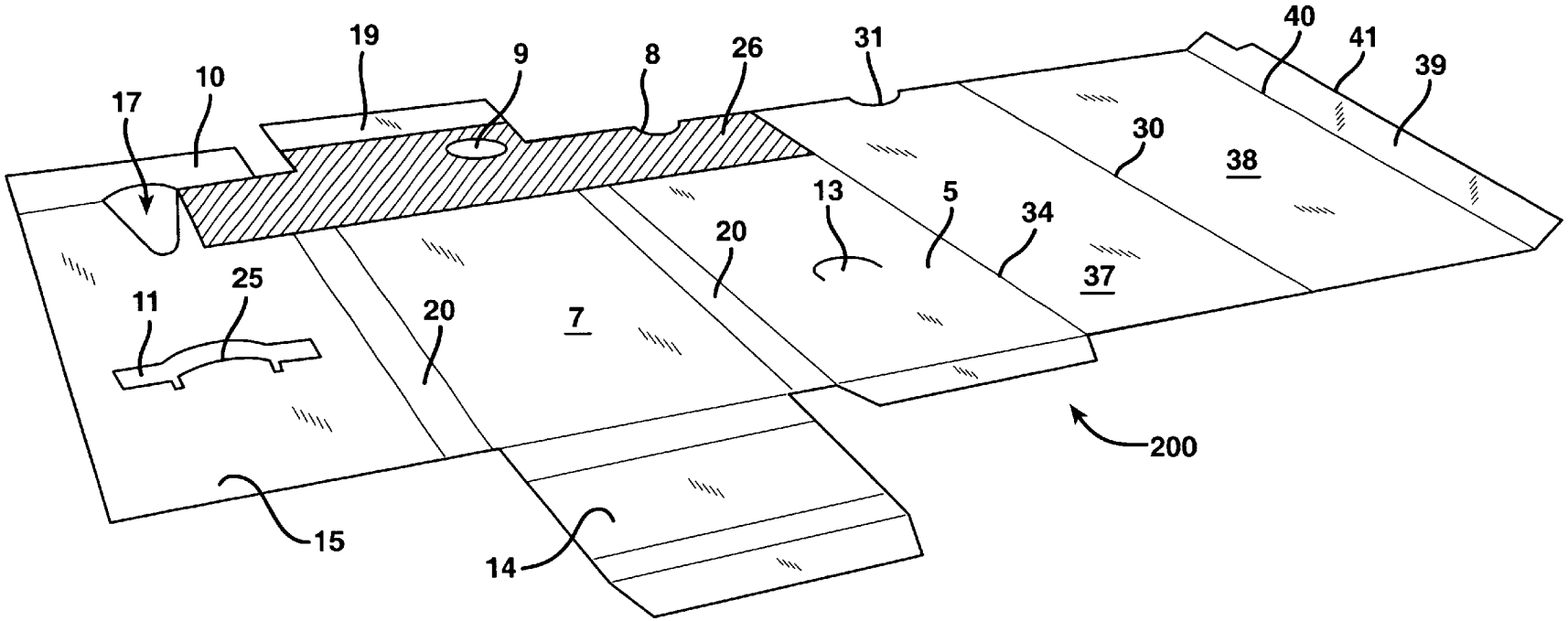
FIG. 9 is a plan drawing of an alternative sleeve blank having an end flap for securing the extension panel used to form the interior pocket.

In an alternative embodiment of the invention, depicted in FIG. 9, blank 100 comprises an extension panel composed of a notched section 37 and an adjacent section 38, which is separated from section 37 by a fold line 30. Section 38 is terminated by an end flap 39 that is of approximately equivalent length but lesser width in relation to the section 38. After the blank is folded and glued to form the outer sleeve, the pocketed exterior panel is formed by folding edge 41 of end flap 39 inward toward the center of the blank and flush against section 38, then folding the folded end flap 39 inward to lay flush against section 37 and gluing it into position against one edge thereof. The presence of the end flap 39 facilitates easier gluing of the exterior panel, particularly during machine processing.

The embodiment of FIG. 9 also shows one possible alternate positioning of the reinforcing tape strip 26, in which tape 26 is flush with the edge of panel 5 and the edge folds of panels 7 and 15, and overlays and protects notches 8 and 9.

Figure 10:
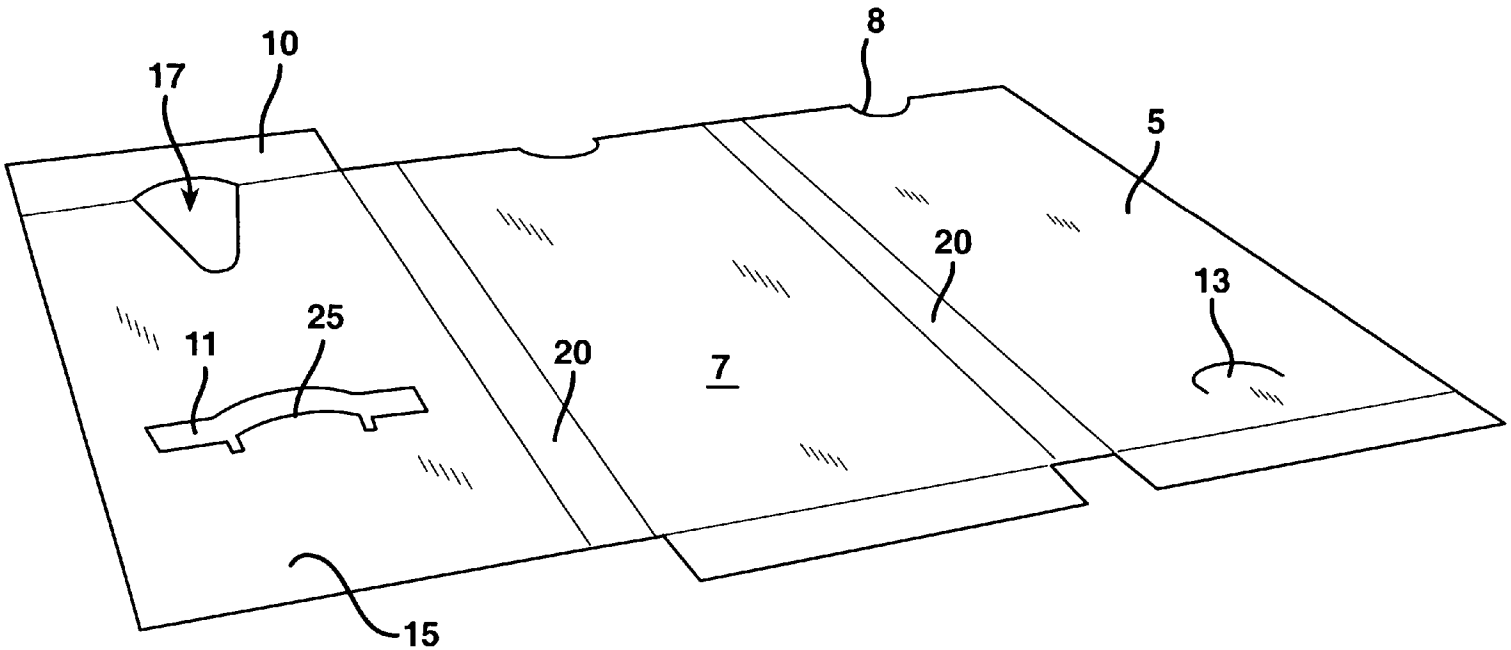
FIG. 10 PRIOR ART
FIG. 10 is a plan drawing of the sleeve used in the prior art unit dose packaging system, as described in U.S. Pat. No. 6,047,829.

FIG. 10 represents a blank for forming a sleeve according to the invention of U.S. Pat. No. 6,047,829.

Figure 11:
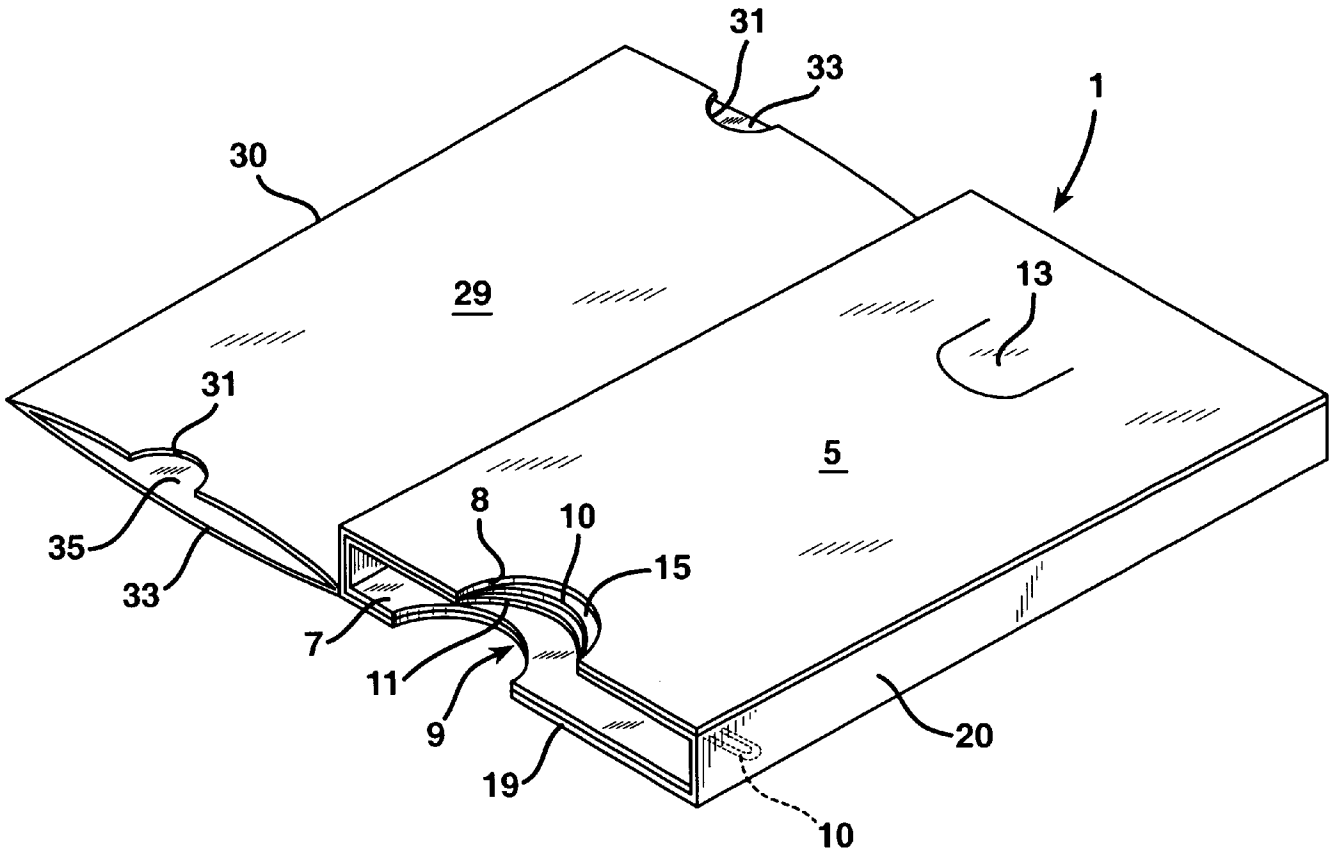
FIG. 11 is an isometric view of the outer sleeve of the package of the invention showing the offset notches for removal of the internal slide card and doubled thickness of substrate material in the region of the notches.

FIG. 11 is an isometric view of the folded outer sleeve 1 showing offset placement of the notches 8 and 9, as well as the doubled thickness formed by folded extensions 10 and 19 around the open edges.

Figure 12:
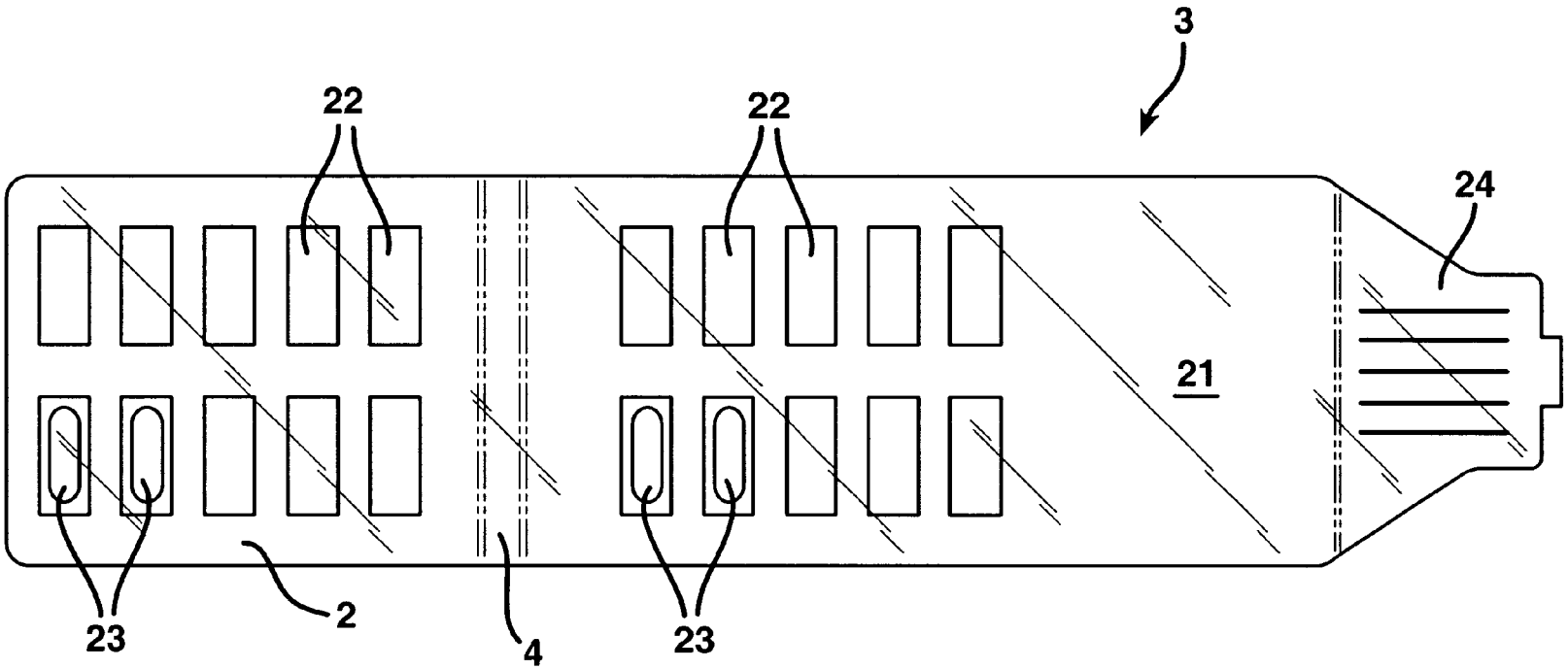
FIG. 12 is a planar representation of the foldable internal slide card used in the package of the present invention.
Figure 13:
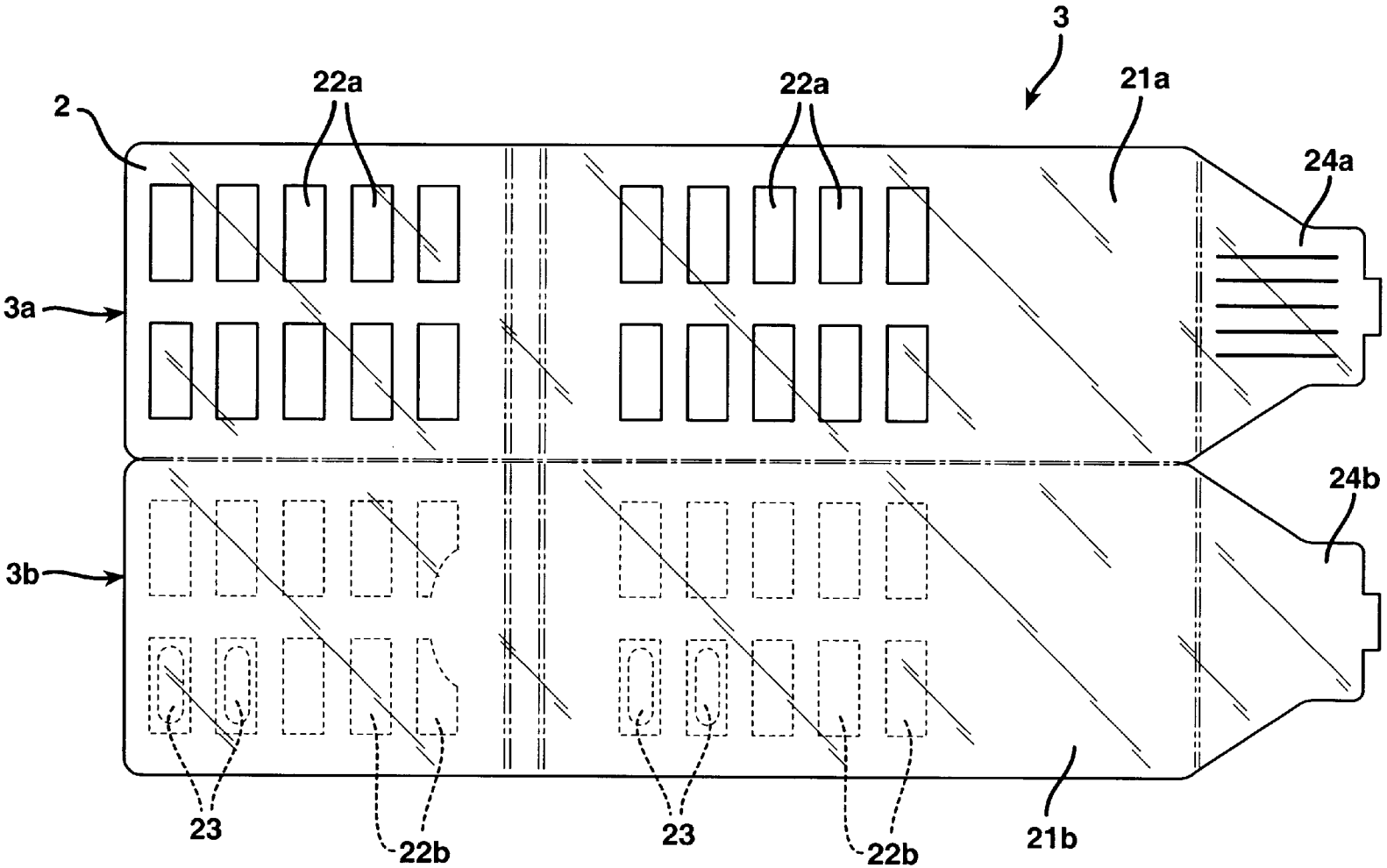
FIG. 13 is a planar representation of a blank for forming the internal slide card according to a preferred embodiment of the invention.

FIGS. 12 and 13 provide planar views of the internal slide card 3 and the blank therefor, respectively. Slide card 3 is composed of the slide card body 21, and a slide card extension 2. The extension 2 is inserted into the package when it is closed. This folding feature allows a longer slide card, which is capable of holding a larger number of unit doses, to be incorporated into the package. Additionally, the folded slide card provides additional structural support within the sleeve. Fold lines scored in the panel 3 form fold panel 4, which conforms to the internal dimensions of the package and is approximately symmetrical to end panel 6. As shown in FIG. 10, two symmetrical sections 3*a* and 3*b* fold together and may be glued or otherwise adhered together to form the internal slide card 3. Slide card body 21 and extension 2 include perforated areas 22*a* and dose holes 22*b*, which together form blisters 22 for containing unit doses 23. The slide card 3 also includes a notch-shaped foldable extension 24, formed from adhered sections 24*a* and 24*b*. The extension 24 is an element of the locking mechanism of the package.

When the package is formed, the slide card 3 is inserted between panels 5 and 7 and pushed inward such that the edge of folded extension 24 springs upward and becomes biased against node 25. This engagement with node 25 prevents the slide card 3 from being removed unless release button 13 is depressed to allow depression of panel 15. By this means, the extension 24 is disengaged from the node 25, and the depression of the panel 15 prevents re-engagement. The slide card 3 may then be withdrawn from the sleeve until the extension 24 becomes engaged within the fold formed by extension 10 and panel 15. The locking and release mechanism is further described in U.S. Pat. No. 6,047,829.

The package of the present invention offers advantages in that it is lightweight, tamper resistant, senior friendly, durable, easy to assemble, offers protection of each unit dose until it is consumed, and is economical. Moreover, the invention provides a child resistant yet user-friendly unit dose packaging container, which may be used to contain and dispense a variety of contents. The improved tamper resistant features of the package may be attributed, at least in part, to the presence of the false bottom structural support, the offset notch placement and the use of partially or fully laminated structural materials in construction of the package sleeve and slide card. Suitably, the package may, for example, be used to store pharmaceuticals preparations requiring repeat periodic dosage regimens. As used herein, the term "pharmaceutical preparation" is intended to include prescribed or over the counter drugs or supplements, vitamins or other medicaments, or any other materials suitable for containment in a package of foil/paperboard or plastic construction. In addition, the package is equipped to hold one or more insert sheets carrying textual or graphic information. Such information is also optionally included on the exposed surfaces of the exterior panel.

It is believed that the present invention includes many other embodiments that may not be herein described in detail, but would nonetheless be appreciated by those skilled in the art from the disclosures made. Accordingly, this disclosure should not be read as being limited only to the foregoing examples or only to the designated preferred embodiments.

We claim:

1. A unit dose package having improved child resistance characteristics comprising a) an outer sleeve including a plurality of side panels, a plurality of hinge panels, said side panels and hinge panels being operatively connected to each other; and wherein at least one side panel includes a foldable extension thereof, said extension being folded toward the interior of the sleeve to form a false bottom; and further wherein one of the side panels includes an internal slide card retaining element and a first inner slide card releasing element, and another of said plurality of side panels includes a second inner slide card releasing element;

wherein the outer sleeve includes a pair of offset notches for grasping and removing an internal slide card; and wherein the outer sleeve is at least partially laminated with a polymeric film material;

b) a foldable exterior panel hingedly attached to one edge of the outer sleeve, said exterior panel being formed from an extension panel divided into two sections by a fold line, the sections being folded about the fold line to form the exterior panel having an interior pocket; and c) an internal slide card having encapsulated thereon one or more blisters each containing a unit dose of a material to be dispensed, the slide card being comprised of a slide card body and an extension, the extension being folded inward and positioned parallel to the slide card body when the package is closed.

2. The package of claim 1, wherein the exterior panel is separated from the outer sleeve by a perforated fold line.

3. The package of claim 1 wherein the exterior panel has notched openings for access to and withdrawal of the contents of the interior pocket.

4. The package of claim 1 wherein the extension panel additionally comprises an end flap separated therefrom by a fold line; said end flap being inwardly foldable for attachment to the extension flap to form an interior pocket.

5. The package of claim 1 wherein the polymeric film material is in the form of a tape strip around one or more edges of the outer sleeve.

6. The package of claim 1, wherein the polymeric film material is laminated over an entire surface of the outer sleeve.

7. The package of claim 1, wherein the outer sleeve is constructed from a paperboard or plastic substrate.

8. A method of packaging unit dose materials comprising:

a) cutting a blank for forming an outer sleeve from a substrate material, the blank having an extension panel having a fold line disposed thereon; the blank further including a pair of notches positioned in an offset parallel relationship to each other when the blank is folded;

b) forming an internal slide card from a substrate material, said internal slide card including a body and a foldable extension thereof c) folding the blank to form an outer sleeve including a plurality of side panels, the side panels having included therein at least one slide retaining means and at least one slide releasing means, at least one side panel comprising a foldable extension thereof which, when folded, forms a false bottom within the interior of the sleeve;

d) folding the extension panel about the fold line and affixing the edge thereof to the outer sleeve to provide a symmetrically folded exterior panel with an interior pocket;

e) encapsulating unit doses of a material onto the internal slide card;

f) folding the extension of the slide card to position the extension parallel to the body of the slide card;

g) inserting the folded slide card into the sleeve such that the extension thereof becomes slidably and lockably engaged with the slide retaining means in the side panels of the sleeve; and h) placing an insert within the interior pocket of the exterior panel.

9. The method of claim 8 further including laminating at least a portion of the outer sleeve with a polymeric film material.

10. The method of claim 8, wherein the unit dose material is a pharmaceutical.

11. A blank for forming a lockable outer sleeve for housing an internal slide card of a unit dose package, comprising a plurality of side panels, an extension panel, and a plurality of hinge panels; at least one of said side panels comprising an extension thereof forming an internal slide card retaining element, and at least one side panel thereof additionally comprising a first internal slide card releasing element; and at least another side panel comprising a second internal slide card releasing element; and the extension panel having a fold line disposed thereon; and further comprising, in combination, a pair of notches, each notch being formed along an outer edge of the sleeve in an offset parallel relationship to the other, and a false bottom formed by a foldable extension of at least one side panel.

12. The blank of claim 11 additionally comprising an end flap separated therefrom by a fold line, said end flap being inwardly foldable for attachment to the extension flap to form an interior pocket.

13. The blank of claim 11 wherein the internal slide card retaining element is formed from an extension of one or more side panels.

14. The blank of claim 11, wherein the first internal slide card releasing element is in the form of a release button located in one side panel.

15. The blank of claim 11, wherein the second internal slide card releasing element is in the form of a cutaway located in one side panel.

16. The blank of claim 15, wherein the cutaway additionally includes a node for engagement of an edge of the internal slide card.

17. The blank of claim 11 further including a polymeric film material laminated over at least a portion of one or both surfaces thereof.

18. The blank of claim 17 having a strip of polymeric film material affixed at or near the edge of at least one panel thereof.

19. The blank of claim 18 wherein the strip covers one or both of the notches formed along the edge of the outer sleeve.

20. A unit dose package having improved child resistance characteristics comprising:

an outer sleeve including a plurality of side panels, a plurality of hinge panels, said side panels and hinge panels being operatively connected to each other; and wherein at least one side panel includes a foldable extension thereof, said extension being folded toward the interior of the sleeve to form a false bottom; and further wherein one of the side panels includes an internal slide card retaining element and a first inner slide card releasing element, and another of said plurality of side panels includes a second inner slide card releasing element; wherein the outer sleeve includes a pair of offset notches for grasping and removing an internal slide card; and wherein the outer sleeve is at least partially laminated with a polymeric film material; an internal slide card having encapsulated thereon one or more blisters each containing a unit dose of a material to be dispensed, the slide card being comprised of a slide card body and an extension, the extension being folded inward and positioned parallel to the slide card body when the package is closed.

* * * * *